United States Patent [19]

White, Jr.

[11] Patent Number: 4,717,320

[45] Date of Patent: Jan. 5, 1988

[54] GEROTOR MOTOR BALANCING PLATE

[76] Inventor: Hollis N. White, Jr., 243 Pyle La., Hopkinsville, Ky. 42240

[21] Appl. No.: 798,301

[22] Filed: Nov. 15, 1985

Related U.S. Application Data

[63] Continuation-in-part of Ser. No. 603,994, Apr. 26, 1984, abandoned, which is a continuation of Ser. No. 390,328, Jun. 21, 1982, abandoned, which is a continuation-in-part of Ser. No. 360,832, Mar. 23, 1982, Pat. No. 4,454,744, which is a continuation-in-part of Ser. No. 113,400, Jan. 18, 1980, Pat. No. 4,357,133, which is a continuation of Ser. No. 910,075, May 26, 1978, abandoned.

[51] Int. Cl.[4] ..... F01C 9/08; F01C 1/10

[52] U.S. Cl. ..... 418/61 B; 418/133

[58] Field of Search ..... 418/61 B, 132, 133

[56] References Cited

U.S. PATENT DOCUMENTS

| | | | |
|---|---|---|---|
| 2,884,865 | 5/1959 | Pettibone | 418/133 X |
| 2,962,973 | 12/1960 | Pettibone | 418/133 X |
| 2,996,997 | 8/1961 | Oliver | 418/132 |
| 3,051,091 | 8/1962 | Bennett et al. | 418/132 X |
| 3,244,111 | 4/1966 | Shelhart | 418/133 |
| 3,619,093 | 11/1971 | Harle et al. | 418/133 X |
| 3,752,609 | 8/1973 | Niemiec et al. | 418/133 |
| 4,177,025 | 12/1979 | Eisenmann et al. | 418/133 |
| 4,264,288 | 4/1981 | Wusthof et al. | 418/133 X |
| 4,540,347 | 9/1985 | Child | 418/133 X |

FOREIGN PATENT DOCUMENTS

| | | | |
|---|---|---|---|
| 962131 | 2/1975 | Canada | 418/133 |
| 1196507 | 8/1965 | Fed. Rep. of Germany | 418/132 |
| 905783 | 9/1962 | United Kingdom | 418/132 |

*Primary Examiner*—John J. Vrablik
*Assistant Examiner*—Theodore Olds
*Attorney, Agent, or Firm*—Woodling, Krost & Rust

[57] ABSTRACT

A balancing plate for rotor valved gerotor motors is disclosed. The balancing plate is mounted on the opposite side of the high pressure rotor valving input with its own connection to high pressure to compensate for the pressure imbalance in the device.

17 Claims, 6 Drawing Figures

GEROTOR MOTOR BALANCING PLATE

This invention relates to a balancing plate for gerotor devices.

This present application is also a continuation-in-part of now pending application Ser. No. 603,994 filed Apr. 26, 1984 and now abandoned, which application is a continuation of now abandoned Ser. No. 390,328 filed June 21, 1982, which application is a continuation-in-part of Ser. No. 360,832 filed Mar. 23, 1982, now issued as U.S. Pat. No. 4,454,744, which application is a continuation-in-part of Ser. No. 113,400 filed Jan. 18, 1980, now issued as U.S. Pat. No. 4,357,133, which application is a continuation of Ser. No. 910,075 filed May 26, 1978, now abandoned.

BACKGROUND OF THE INVENTION

Gerotor devices operate with a pressure differential between an input and an output: a motor utilizes this differential to turn a shaft, a pump creates this differential. There is, however, a loss of energy in the transformation of physical forces from or into a pressure differential. Some of this energy is lost due to the effects of pressure imbalance within the gerotor device. For example, in a gerotor motor with rotor valving, the high pressure feed into the rotor physically forces the rotor away from the surface of high pressure feed. This separation not only reduces the efficiency of the motor due to leakage but also increases the wear on the opposite side of the rotor. In the past the gerotor devices have been designed with extra size and strength to contain the physical forces created by the pressure imbalance. In a gerotor motor with rotor valving this means utilizing extra heavy and thick plates on the opposite sides of the gerotor structure. This extra size and strength, however, only contain the pressure imbalance—they do not reduce it. Non-uniform wear and heat remain. The invention of this current application is directed towards a balancing plate to reduce the pressure imbalance within gerotor devices.

It is an object of this invention to equalize the forces within gerotor devices.

It is an object of this invention to increase the efficiency of gerotor devices.

It is an object of this invention to reduce the wear in gerotor devices.

It is an object of this invention to increase the adaptability of gerotor devices.

It is an object of this invention to reduce the size of gerotor devices.

Another object of the invention is to provide a pressure loading plate in the end cover of the housing so as to cause a pressure balance providing a head force towards the manifold and gerotor set.

Other objects and a more complete understanding of the invention may be had by referring to the specification and drawings in which:

DESCRIPTION OF THE INVENTION

Figure 1:
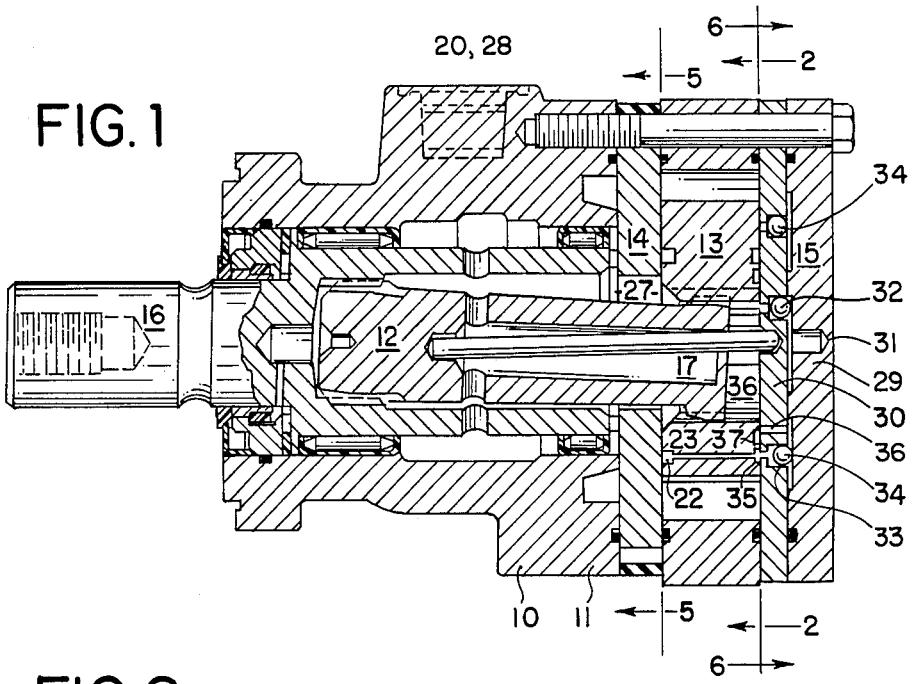
FIG. 1 is a cross-sectional side view of a gerotor motor incorporating the invention of this application, taken generally from lines 1—1 in FIG. 2.

The invention of this application is directed towards a balancing plate to reduce the pressure imbalance in hydraulic devices. The invention will be described in reference to a gerotor motor 10. The motor 10 includes a body 11, a wobblestick 12, a gerotor structure 13, valving plates 14, end plates 15 and an output shaft 16. A wobblestick locating pin 17 locates the wobblestick 12 away from the end plates 15.

For clockwise operation the high pressure fluid enters one port 20 and travels through passages within the body 11 of the motor 10 to pressurize a series of holes 16 on the rotor side holes 17 connected through the valving plates 14. This fluid commutes with a valving groove 22 in the rotor 23 of the gerotor structure 13. The valving groove 22 in the rotor 23 in turn commutes with certain of bidirectional passages in the valving plates 14 to openings 18 in expanding gerotor cells 24 in the gerotor structure 13. From openings 18 in contracting gerotor cells 25 in the gerotor structure 13 the output fluid travels through other of the bidirectional passages in the valving plates 14 to certain holes 17 that commute with the center valving opening 26 in the rotor 23. This output fluid then circulates in the opening 27 about the wobblestick 12 to the other port 28 in the body 11 of the motor 10. For counterclockwise rotation the fluid travels in the opposite direction. The pressurized groove 22/opening 26 of the rotor 23 is in valving connection with certain of the valving holes 17 in the valving plates 14 at all times. (A complete detailed description of the one sided rotor valving is set forth in U.S. Pat. No. 4,474,544 issued Oct. 2, 1984 to Hollis White.)

Ordinarily this rotor valving would cause the rotor 23 to tend to be slightly separated from the valving plates 14 and biased against the end plates 15; the rotor 23 would seek to move away from the high pressure input be it through the rotor's valving groove 22 or the valving opening 26. The separation of the rotor 23 from the valving plates 14 causes some fluid leakage bypassing the gerotor structure 13. This reduces the efficiency of the motor 10. The leakage also produces heat at the plate of leakage. The biasing of the rotor 23 against the end plates 15 produces increased friction with such plates 15. This further reduces the efficiency of the motor 10. This also produces increased wear on the end plates 15.

The invention of this application is a balancing plate 30 that selectively counters the effects of the high pressure imbalance on the rotor 23. The plate accomplishes this by variably biasing the rotor 23 back against the valving plates 14 in opposition to the high pressure imbalance otherwise present on the rotor 23.

Figure 3:
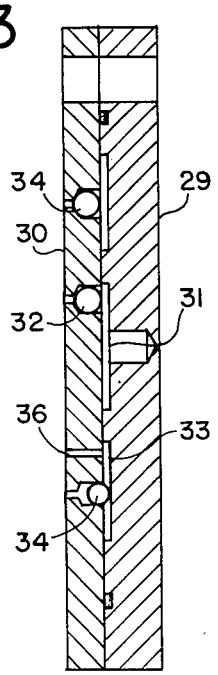
FIG. 3 is an enlarged cross-sectional side view of the balancing plate structure of the gerotor motor of FIG. 1.

The balancing plate 30 as shown in FIG. 3 is fixedly connected at its outer edge to the end plate 15 by the main bolts. The balancing plate 30 includes a central cavity 31 with a one-way check valve 32 connecting such cavity 31 to the valving opening 26 in the rotor, a second surrounding cavity 33 with second one-way check valve 34 connecting such cavity 33 to a groove 35 connected to the outer valving groove 22 in the rotor and an unchecked relief hole 36 connecting the surrounding cavity 33 to a relief groove 37 in the rotor.

Figure 2:
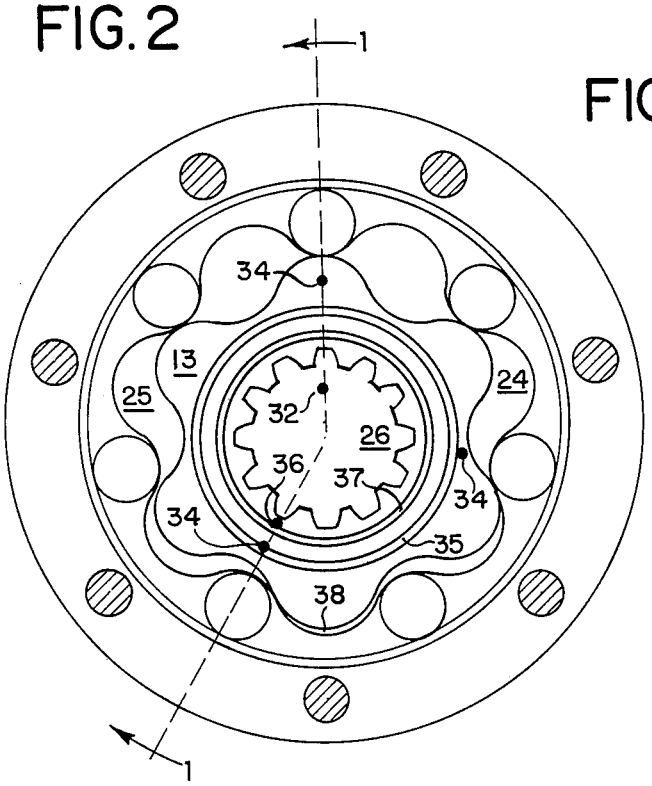
FIG. 2 is a cross-sectional end view of the gerotor section of the gerotor motor of FIG. 1, taken generally from lines 2—2 in that figure.

As shown in FIG. 2 the placement of the check valve 32 is not critical; there is a large central area that will be swept only by the valving opening 26 in the rotor.

The placement of the second check valve 34 and the relief hole 36 is more critical. The check valves 34 must be located in positions such that they are within the confines of the space swept by the groove 35 and are not swept by the outer edge 38 of the rotor 23 (and preferably not swept by the relief groove 37 as well). The relief hole 36 must be located in a position such that it is within the confines of the space swept by the relief groove 37 and preferably not swept by either the central valving opening 26 or the groove 35. Note that it is not necessary for the check valves 32, 34 or relief hole 36 to be in constant communication with their respective grooves or openings in the rotor 23; the check valves 32, 34 and relief hole 36 need only occasionally communicate with their respective grooves or openings to produce the balancing effect. In the device shown the check valve 32 is in constant communication with the valving opening 26, one of the three check valves 34 are in semi-constant communication with the groove 35, and the relief hole 36 is in intermittent communication with the relief groove 37.

Due to the cooperation between the check valves 32, 34 the balancing plate 30 is biased against the rotor 23. When outer valving groove 22 is the high pressure groove, the fluid passes from groove 35 through one of the check valves 34 to pressurize the outer and surrounding cavity 33 between the balancing plate 30 and the other end plate 29. This pressure builds up to bow the balancing plate 30 towards the rotor 23. This bowing biases the rotor 23 against the valving plates 14 to equalize the axial pressure on the rotor 23. The pressure leakage between the balancing plate 30 and the other end plate 29 will close the other check valve 32 and hold it shut. When the central valving opening 26 is the high pressure feed, the fluid passes from such opening through check valve 32 to pressurize the central cavity 31 between the balancing plate 30 and the other plate 29. The pressure again builds up to bow the balancing plate 30 towards the rotor 23 to equalize the pressure thereon. The pressure leakage between the balancing plate 30 and the other end plate 29 will close the other check valves 34 and hold them shut.

The relief hole 26 by communicating with only the relief groove 37 in the rotor 23 provides a safety against too great a buildup of pressure between the balancing plate 30 and the reaction plate 29.

The exact size and location of the cavities 31, 33 and the thickness of the plates 29, 30 are chosen to provide the appropriate degree of counter-biasing forces on the rotor 23. In general: (a) the cavity 31 should have a surface area slightly smaller than the area swept by the valving opening 26 on the valving plate 14, (b) the cavity 33 should have a surface area generally tracking the area swept by the valving groove 22 on the valving plate 14, and (c) the plate 29 as a reaction plate should be relatively stiff.

The balancing forces in the motor 10 produced by the flexing of the balancing plate 30 are designed to equalize the forces on the rotor 23 otherwise developed by the pressure imbalance within the device. No matter which direction the motor 10 is rotated the proper amount of equalizing force will be present on the rotor 23 so as to maintain the rotor 23 centrally within the gerotor structure 13. Both sides of the rotor 23 will therefore be subject to the same amount of wear, leakage, etc. This vastly increases the longevity of the gerotor device. By balancing and not just containing the pressure caused imbalance in the device the device can be made smaller and of less rigid materials.

Figure 4:
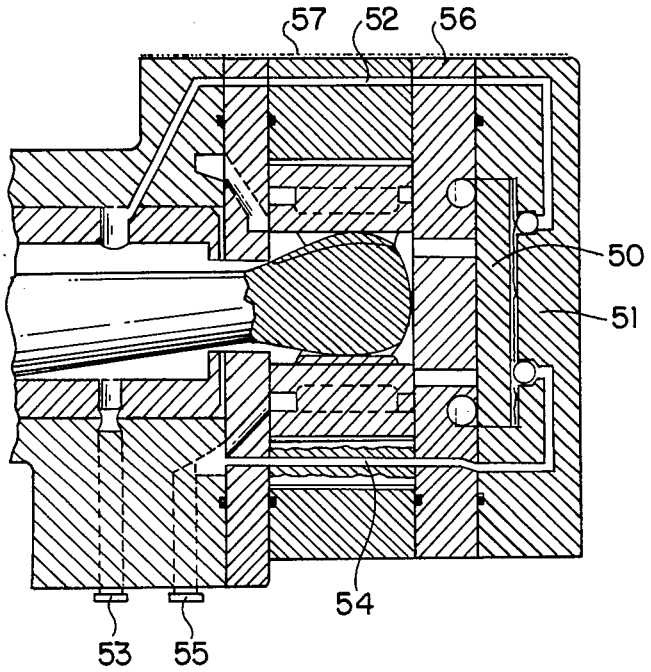
FIG. 4 is a cross-sectional end view of a gerotor section of a gerotor motor incorporating a pressure loading plate.
Figure 5:
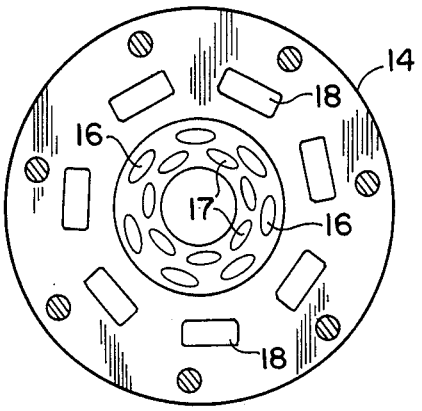
FIG. 5 is a cross-sectional end view of the manifold plate of the gerotor motor of FIG. 1, taken generally from lines 5—5 of that Figure.
Figure 6:
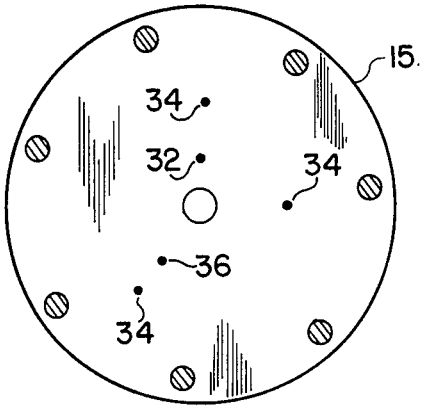
FIG. 6 is a cross-sectional end view of the balancing plate of the gerotor motor of FIG. 1, taken generally from lines 6—6 of that figure.

FIG. 4 shows a portion of the righthand end of a gerotor mechanism like FIG. 1 incorporating a separate pressure loading plate. However, in FIG. 4 there has been added a pressure plate 50 inserted in a suitable recess in the end cap 51, and the end cap is pushed toward the left as viewed in FIG. 4 by means of pressure admitted through lines 52, connected with the exhaust 53, and line 54 connected with the intake 55. Each of the lines 52 and 54 has adjacent the pressure loading plate 50 a ball check valve 55 so that the loading plate 50 is always pressured inwardly toward the manifold 56 and the gerotor set 57 beyond it. This provides a head force towards the manifold and rotor set. This will take care of any wear between the engaging rubbing portions 56 and 57. This separate pressure loading plate functions similarly to the balancing plate by flexing the manifold plate.

Although this invention has been described in its preferred form with a certain degree of particularity, it is to be understood that numerous changes can be made without departing from the invention. For example any device having unequal pressure on a moving part could benefit from the invention. This would include rotary valves and the like. The invention is hereinafter claimed.

What is claimed is:

1. In a pressure device having a moving part confined between first and second plates with high pressure biasing the moving part more against the second plate than the first plate so as to create an imbalance of the forces between moving part and the first and second plates, an improvement of a means to counter the high pressure biasing of the moving part so as to compensate for the otherwise inbalance of forces between the moving part and the first and second plates, said means comprising a balancing plate, said balancing plate being between the second plate and the moving part, means to fixedly connect said balancing plate to the second plate, means to contain pressure between said balancing plate and the second plate and means to pressurize said means to contain pressure between said balancing plate and the second plate so as to bow said balancing plate back against the moving part and force the moving part against the first plate so as to compensate for the otherwise imbalanced forces between the first and second plates and the moving part.

2. The improved pressure devices of claim 1 wherein the pressure bias of the moving part against the second plate has a certain valve and characterized in that said means to contain pressure between said balancing plate and the second plate has a certain size, and said certain size being chosen so as to substantially equalize the pressure bias of the moving part on the first and second plates.

3. The improved pressure device of claim 1 characterized by the addition of a relief means connected to said means to contain pressure between said balancing plate and the second plate so as to prevent the build up of too great a pressure between said balancing plate and the second plate.

4. The improved pressure device of claim 1 wherein the moving part has a fluid passage therein and characterized in that said means to pressurize said means to contain pressure between said balancing plate and the second plate includes the fluid passage in the moving part.

5. The improved pressure device of claim 4 characterized in that the fluid passage in the moving part intermittently valves said means to pressure said means to contain pressure between said balancing plate and the second plate.

6. The improved pressure device of claim 1 wherein the moving part has two fluid passages therein and characterized in that said means to contain pressure between said balancing plate and the second plate includes one of the two fluid passages.

7. The improved pressure device of claim 6 characterized by the addition of a valve means, said valve means selectively connecting said means to contain pressure between said balancing plate and the second plate to the fluid passage of the two fluid passages having the higher pressure.

8. In a device having a rotating valving member confined between first and second flat plates with a high pressure commutation and valving on one side of the valving member and with the first plate, the high pressure biasing the valving member more against the second plate than the first plate so as to create an imbalance of the forces between the valving member and the first and second plates, an improvement comprising a balancing plate, said balancing plate being between the second plate and the valving member, means to fixedly connect said balancing plate to the second plate, means to contain pressure between said balancing plate and the second plate and means to pressurize said means to contain pressure between said balancing plate and the second plate so as to bow said balancing plate back against the valving member and force the valving member against the first plate so as to compensate for the imbalance of forces due to the single sided high pressure commutation and valving.

9. The improved device of claim 8 wherein the device has two different alternate high pressure commutation possibilities between the valving member and the first plate.

10. The improved device of claim 9 characterized in that said means to pressurize said means to contain pressure between said balancing plate and the second plate includes a check valve means to connect to one of the two different alternate pressure commutation possibilities of the device which is then subject to high pressure commutation.

11. The improved gerotor device of claim 10 wherein one of said means to selectively connect said containment means to one of the two fluid passages and said means to selectively connect said containment means to the other of the two fluid passages includes fluid travel through the rotor.

12. The improved device of claim 8 wherein the device is a gerotor device with the rotor also functioning as the valving member.

13. In a gerotor device having a rotating and orbiting rotor confined between first and second plates, with the rotor having commutation from two fluid passages and valving to expanding and contracting gerotor cells on only one side of the rotor and with the first plate, either of the two fluid passages being selectively connected to high pressure, and the high pressure biasing the rotor more against the second plate than the first plate so as to create an imbalance of the forces between the rotor and the first and second plates, an improvement comprising a balancing plate, said balancing plate being between the second plate and the rotor, means to fixedly connect said balancing plate to the second plate, containment means to contain pressure between said balancing plate and the second plate, means to selectively connect said containment means to one of the two fluid passages if such one fluid passage is connected to high pressure and means to selectively connect said containment means to the other of the two fluid passages if such other fluid passage is connected to high pressure, the resultant pressure in said containment means bowing the balancing plate back against the rotor and force the rotor against the first plate so as to compensate for the imbalance of forces due to the single sided high pressure commutation and valving.

14. The gerotor device of claim 13 wherein the rotor has two grooves on a surface facing the first plate with the two grooves respectively forming the commutation from the two fluid passages and the valving to the expanding and contracting gerotor cells and characterized in that said means to selectively connect said containment means to one of the two fluid passages include fluid travel through one of the two grooves and said means to selectively connect said containment means to the other of the two fluid passages includes fluid travel through the other of the two grooves.

15. The gerotor device of claim 13 characterized in that said means to selectively connect said containment means to one of the two fluid passages includes a check valve and said means to selectively connect said containment means to the other of the two fluid passages also includes a check valve.

16. The improved gerotor device of claim 15 characterized in that said first and second check valve means operate intermittently.

17. In a gerotor device having a rotating and orbiting rotor confined between first and second flat plates, with the rotor having two grooves on one surface facing the first plate forming respectively two fluid passages and valving to expanding and contracting gerotor cells on only one side of the rotor and with the first plate, either of the two fluid passages being selectively connected to high pressure, and the high pressure biasing the rotor more against the second plate than the first plate so as to create an imbalance of the forces between the rotor and the first and second plates, an improvement comprising a balancing plate, said balancing plate being between the second plate and the rotor, means to fixedly connect said balancing plate to the second plate, containing means to contain pressure between said balancing plate and the second plate, a first transfer groove, said first transfer groove being on the surface of the rotor facing the second plate, means within the rotor to connect said first transfer groove to one of the commutation and valving grooves, first check valve means to selectively connect said containment means to said first transfer groove if the respective one fluid commutation and valving groove is connected to high pressure and a second transfer groove, said second transfer groove being on the surface of the rotor facing the second plate, means within the rotor to connect said second transfer groove to the other commutation and valving groove, second check means to selectively connect said containment means to said second transfer groove if the respective other fluid commutation and valving groove is connected to high pressure, the resultant pressure in said containment means bowing the balancing plate back against the rotor and force the rotor against the first plate so as to compensate for the imbalance of forces due to the single sided high pressure commutation and valving.

* * * * *